US007243775B2

(12) United States Patent
Novacek et al.

(10) Patent No.: US 7,243,775 B2
(45) Date of Patent: Jul. 17, 2007

(54) HANDRAIL FOR AN ESCALATOR OR MOVING WALK AND ESCALATOR OR MOVING WALK WITH SUCH A HANDRAIL

(76) Inventors: Thomas Novacek, c/o Schweitzer Cornman Gross & Bondell LLP, 292 Madison Ave., 19th Floor, New York, NY (US) 10017; Thomas Illedits, c/o Schweitzer Cornman Gross & Bondell LLP, 292 Madison Ave. 19th Flr., New York, NY (US) 10017

( * ) Notice: Subject to any disclaimer, the term of this patent is extended or adjusted under 35 U.S.C. 154(b) by 0 days.

(21) Appl. No.: 11/430,763

(22) Filed: May 9, 2006

(65) Prior Publication Data

US 2006/0260906 A1 Nov. 23, 2006

(30) Foreign Application Priority Data

May 9, 2005 (EP) ..... 05103826

(51) Int. Cl.
*B66B 23/00* (2006.01)

(52) U.S. Cl. ..... 198/337; 198/335

(58) Field of Classification Search ..... 198/335, 198/336, 337, 338
See application file for complete search history.

(56) References Cited

U.S. PATENT DOCUMENTS

| | | | | |
|---|---|---|---|---|
| 1,101,209 | A * | 6/1914 | Pitt | 198/337 |
| 2,766,868 | A * | 10/1956 | Tilton | 198/337 |
| 2,919,786 | A * | 1/1960 | Tilton | 198/337 |
| 3,688,889 | A * | 9/1972 | Koch et al. | 198/337 |
| 3,749,224 | A | 7/1973 | Engeler | |
| 3,865,225 | A | 2/1975 | Phal | |
| 4,836,353 | A * | 6/1989 | Adrian et al. | 198/335 |
| 5,226,522 | A * | 7/1993 | Johnson et al. | 198/335 |
| 5,255,772 | A * | 10/1993 | Ball et al. | 198/337 |
| 6,237,740 | B1 * | 5/2001 | Weatherall et al. | 198/337 |
| 6,497,318 | B2 * | 12/2002 | Schulte et al. | 198/337 |
| 6,540,228 | B2 * | 4/2003 | Delello | 273/274 |
| 6,673,431 | B1 * | 1/2004 | Ledzinski | 428/292.1 |
| 7,041,195 | B2 * | 5/2006 | McLeod et al. | 156/324 |

FOREIGN PATENT DOCUMENTS

| | | |
|---|---|---|
| EP | 0 603 993 A1 | 6/1994 |
| FR | 2 757 143 A1 | 6/1988 |
| JP | 03 088 694 A | 7/1991 |

* cited by examiner

*Primary Examiner*—Douglas Hess
(74) *Attorney, Agent, or Firm*—Schweitzer Cornman Gross & Bondell LLP

(57) ABSTRACT

A handrail for an escalator or moving walk that has a fixed guide device and a handrail body that moves along the guide device when in operation is disclosed. The guide device has a form-giving guide section that contains a lip-guide that extends along a longitudinal direction of the guide section. The handrail body is strip-shaped and has two edge-lips that extend along two longitudinal edges of the strip-shaped handrail body. The edge-lips are formed in such manner that they run parallel to the longitudinal direction when the handrail body moves in the lip guide. The guide section essentially defines the form of the handrail in both the direction parallel to the longitudinal direction and in a cross-sectional plane perpendicular to the longitudinal direction.

16 Claims, 7 Drawing Sheets

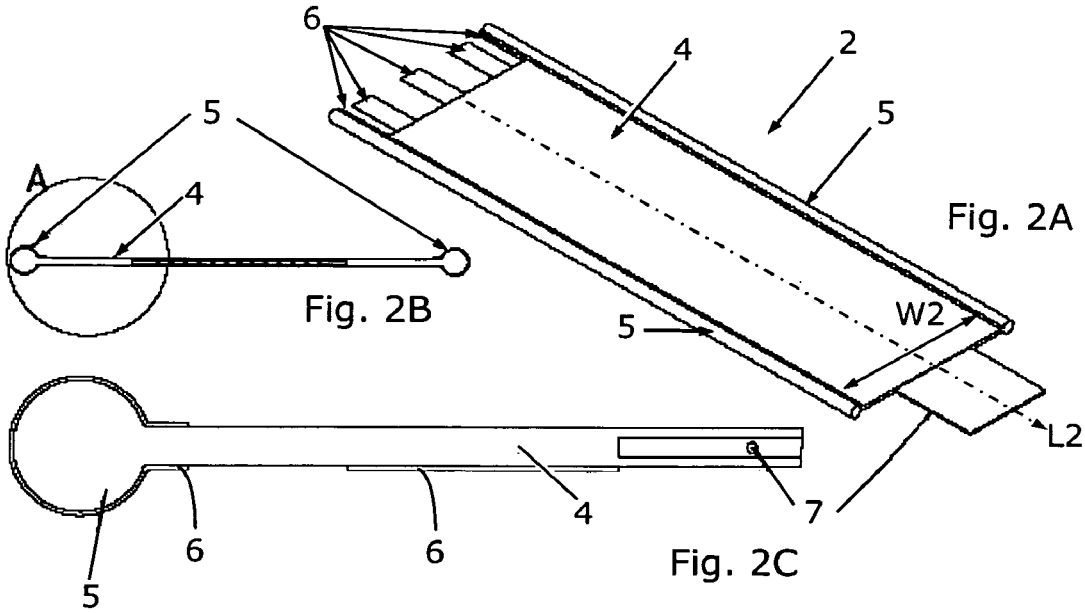
6
4
2
5
5
A
4
Fig. 2A
Fig. 2B
5
W2
L2
4
7
6
6
5
Fig. 2C
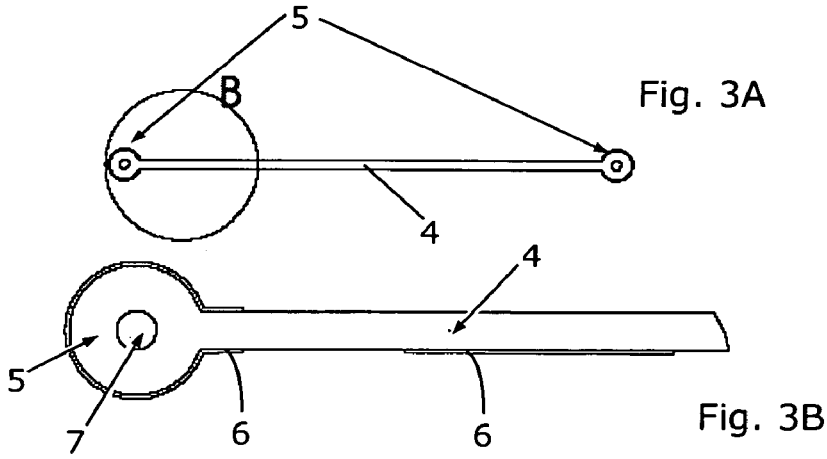
5
B
Fig. 3A
4
4
5
7
6
6
Fig. 3B

HANDRAIL FOR AN ESCALATOR OR MOVING WALK AND ESCALATOR OR MOVING WALK WITH SUCH A HANDRAIL

The present invention relates to an escalator or moving walk with a circulating handrail that has a fixed guiding device and a handrail body that moves along the guiding device when in operation.

BACKGROUND OF THE INVENTION

There are numerous embodiments and designs for the handrail of an escalator or moving walk.

To give the passenger a safe grip, handrails are known to have a C-shaped cross section and are usually constructed from a number of different materials. The stability of the C-shaped handrail must be assured over its entire life since for safety reasons the gap between the moving handrail and a stationary balustrade must be minimal. Lifting of the handrail by the passenger must also be prevented.

As a result of the required form stability and safety requirements, such handrails have a large volume and high lip rigidity, i.e. a high rigidity of the side areas of the handrail. On account of such form stability, and especially on account of the lip rigidity, a high degree of formability of the handrail is required. For stability and lip rigidity hinder bending of the handrail in the longitudinal direction, particularly in reversing curves, transitional curves, and on the handrail driving wheel. On account of the greater volume and therefore greater weight of the handrail, a drive with a high power output is required to move the handrail.

In addition, a so-called gliding layer that is provided on the inside of the handrail must fulfill two functions simultaneously. The gliding layer is the contact surface of the handrail not only for the handrail guide but also for the handrail drive system. The gliding surface must therefore have good gliding properties with low sliding friction. However, since the same surface is used for driving, it must also have very good static friction since otherwise the handrail cannot be driven.

From Japanese patent publication JP06064881-A of the Hitachi company, a handrail is known that is easy to grip and safe. The handrail has a robust, stationary guiderail. A guiderail embraces a handrail body that moves along the guiderail when the moving walk is in operation. In the area of a machine room, the guiderail—and therefore also the handrail body—has a different cross-sectional form than in the area that is accessible to people.

This constellation is disadvantageous, as the relatively large contact area between the inside of the handrail body and the guiderail causes friction and wear. However, especially critical for safety reasons is the size of the gap between the moving handrail body and the stationary guiderail.

An objective of the present invention is to present an escalator or moving walk of the type stated at the outset that enables safety for the passenger to be improved relative to present solutions.

A further objective of the present invention is to present an escalator or moving walk of the type stated at the outset that has less friction and reduced wear.

Yet a further objective is to improve the driving efficiency for the handrail.

BRIEF DESCRIPTION OF THE INVENTION

According to the invention, the foregoing and other objectives are fulfilled in a moving walk or escalator of the type stated at the outset by the provision of a guide device with a form-giving guide section that contains a lip-guide that extends along a longitudinal direction of the guide section. The handrail body also has two edge-lips. The edge-lips are formed in such manner that they run parallel to the longitudinal direction when the handrail body moves in the lip guide. Through its own form, the guide section defines the form of the handrail, both in the direction parallel to the longitudinal direction and in cross-section.

It is to be seen as an advantage of the invention that the handrail is variable in its cross-sectional form. In especially advantageous embodiments, the handrail can therefore have length portions with different shapes.

It is also regarded as particularly advantageous that the new type of handrail provides improved safety for passenger transportation through a user-friendly and ergonomic shape. In addition, the handrail reduces the flexing work and the power output required from the drive. There is also less wear of the handrail, as its volume and weight are lowered and through separation of the contact surface into a handrail guide surface and a handrail drive surface allowing optimization of the individual surfaces.

Use of the new type of handrail on escalators and moving walks can also achieve an elegant appearance in addition to its functional and safety-related aspects.

BRIEF DESCRIPTION OF THE DRAWINGS

Further characteristics and advantages of the invention are apparent from the following description of exemplary embodiments as further referred to in the annexed drawings, wherein:

FIG. 2A is a depiction of a length of a first base element according to the invention;

FIG. 2B is a cross-section through the first base element 7 of FIG. 2A;

FIG. 2C is an enlarged detail of the first base element;

FIG. 3A is a cross-section through a second base element;

FIG. 3B is an enlarged detail of the second base element;

DETAILED DESCRIPTION OF THE INVENTION

The invention can be used both on escalators that are arranged at an incline and typically connect two or more stories and on moving walks that are arranged horizontally or at an incline. Escalators and moving walks usually have on at least one side a balustrade with a handrail that moves with it.

As used hereinafter, the term "moving walk" is used as a synonym for and to encompass transportation means having the nature of a bridge (moving walk) or the nature of a stairway (escalator) such as are used for the transportation of people or objects. The term "moving walk" is also used as a synonym for and encompasses other transportation systems for people or objects such as are used, for example, in airports to bridge greater distances.

Figures 1A, 1B:
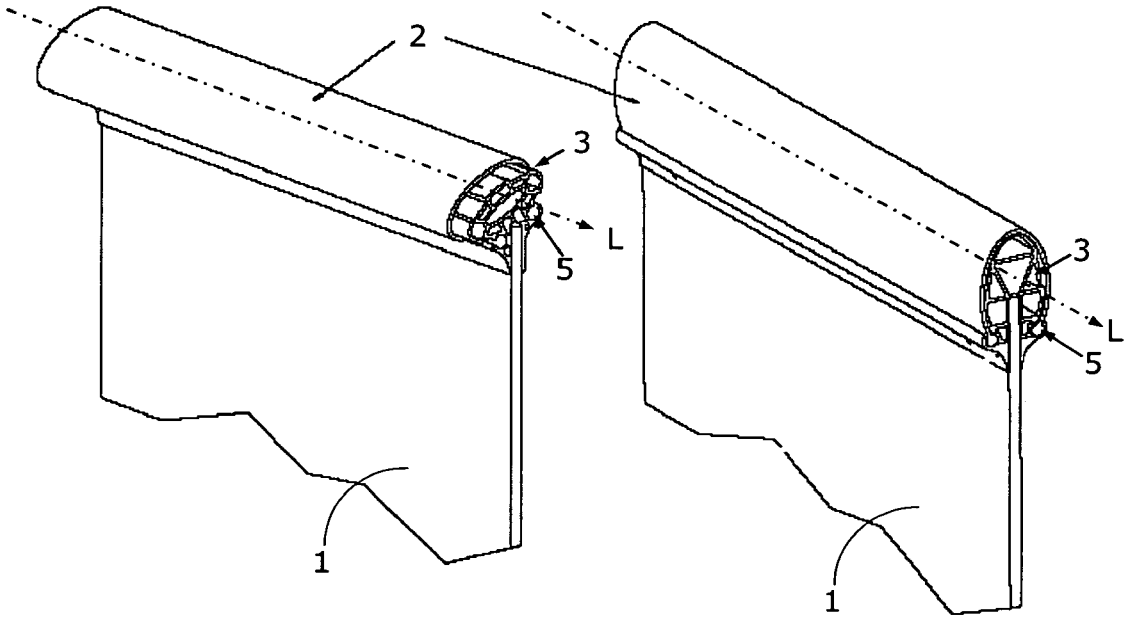
FIG. 1A is a detail view of the balustrade of a moving walk with a first handrail according to the invention.
FIG. 1B is a detail of the balustrade of a moving walk with a second handrail according to the invention.

A first embodiment of the invention is shown in FIG. 1A. Shown in the figure is a detail of a balustrade 1 of a moving walk that includes a handrail.

The moving walk according to the invention is characterized in that the circulating handrail has a fixed guide device and a moving handrail body that moves along the guide device when in operation. From FIG. 1A it can be seen that the guide device has a form-giving guide section 3. Shown in FIG. 1A is a cross section through this guide section 3. Provided according to the invention is a handrail body 2 that is flexible and has two edge-lips 5 that can be seen in FIG. 2A. These edge-lips 5 are formed in such manner that they run parallel to the longitudinal direction L when the handrail body 2 moves in a lip guide 8 of the guide section 3, as may be seen, for example, in FIG. 4A. Through its own form, the guide section 3 essentially defines or controls the form of the handrail in the direction parallel to the longitudinal direction L and in the cross-section perpendicular to the longitudinal direction L. In FIG. 1A this cross-section is mushroom-shaped and in its upper area approximates an oval lying on its side. In contrast, shown in FIG. 1B is an embodiment in which the cross-section is mushroom-shaped and in its upper area approximates to an oval lying on its end.

Shown in FIGS. 2A to 2C and 3A to 3B are various embodiments of handrail bodies 2 according to the invention.

FIG. 2A shows a length of the handrail body 2 according to the invention in a stretched-out, flat form. The handrail body 2 comprises a flexible base element 4 that is executed in the form of a strip. This base element 4 has a longitudinal axis L2 of the strip that in the installed state runs essentially parallel to the longitudinal axis L of the guide section 3. In the area of its two longitudinal edges, the base element 4 has two edge-lips 5 as may also be seen in the cross-section of FIG. 2B. From FIG. 2A it can be seen that the base element 4 has a tension bearer 7 that is located in the base element 4. In the example shown, the tension-bearer 7 is strip-shaped and flat. Shown in FIG. 2C is an enlarged detail of the area A of FIG. 2B. Visible in this enlarged portion are further details of the embodiment. On the edge-lips 5 and on the underside of the base element 4 are so-called gliding surfaces 6 or gliding areas. These gliding surfaces 6 are designed and arranged in such manner that the handrail body 2 can glide along the guide section 3. The gliding surfaces 6 serve primarily to reduce friction, but can also assume a guiding function.

Each of the edge-lips 5 can either be made of a material capable of gliding, or be coated with a material capable of gliding, or be provided with a gliding surface 6.

A further embodiment is shown in FIGS. 3A and 3B. Similar to FIG. 2B, FIG. 3A shows a cross-section through a further handrail body 2. On both longitudinal edges the base element 4 has two edge-lips 5 as may be seen in the cross-section in FIG. 3A. The example shown differs from the embodiment shown in FIGS. 2A-2C in that a tension bearer 7 passes through each of the edge-lips. The tension bearer 7 can, for example, take the form of a steel rope or other rope that is able to absorb the tensile forces that arise and thereby provides the required minimum resistance to elongation to the handrail body 2. Gliding surfaces or areas 6 are also provided on the underside of the base element 4.

The gliding surfaces or gliding areas of the various embodiments can be an integral part of the base element 2 or of the edge-lips 5. They can, however, also be fastened on the base element and/or onto the edge-lips 5.

Figure 4B:
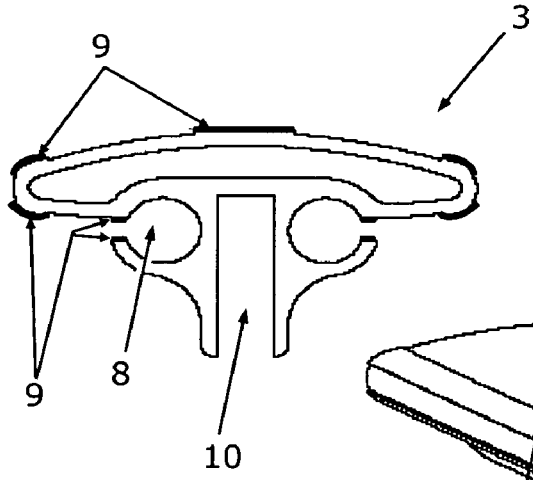
FIG. 4B is a cross-section through the first guide section.
Figure 4A:
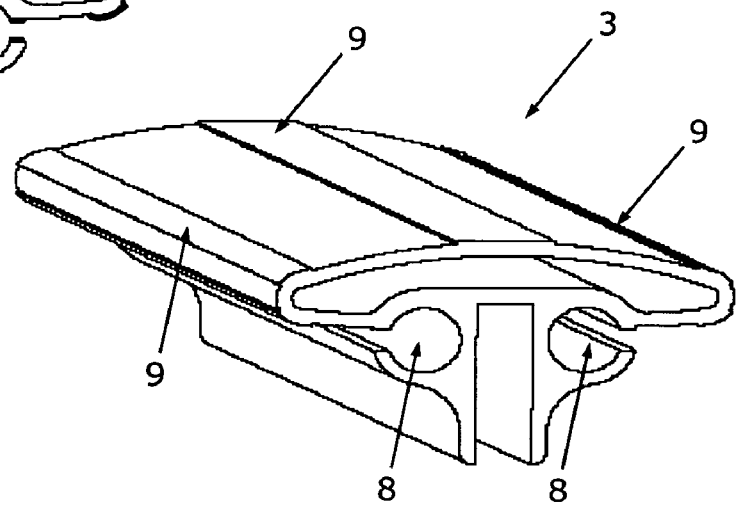
FIG. 4A is a depiction of a length of a first guide section according to the invention.

Shown in FIGS. 4A and 4B are details of an embodiment of the guide section 3. FIG. 4A is a perspective view of a short length of the guide section 3. Shown in FIG. 4B is a cross-section. The guide section 3 has a T-shaped or mushroom-shaped cross-section in which the area of the handrail which the passenger grips with the hand is slightly convex. Provided in the lower area of the guide section 3 are means 10 to fasten the guide section 3 onto a balustrade 1. The means of the example shown is a lengthwise groove that runs parallel to the longitudinal axis L. The guide section 3 can easily be placed onto the upper edge of the balustrade 1 from above. To fix the complete handrail, clamping and/or bolting means can be provided on the guide section 3. Referenced with 9 in FIGS. 4A and 4B are those areas along which the gliding surfaces 6 or gliding areas of the base element 4 glide. In FIG. 4B, this area has been deliberately shown thicker for clarity.

Preferably, but not necessarily, the areas 9 are coated or surface treated so as to reduce the gliding friction on the gliding surfaces 6 or gliding areas of the handrail body.

Depending on the embodiment, the guide section 3 can be made of metal, such as aluminum, or plastic. Other possible materials and constructions are extruded aluminum, rolled, drawn, or milled steel, and extruded plastic.

Figure 5B:
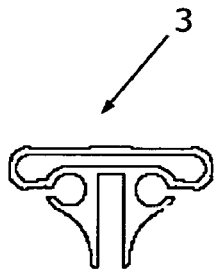
FIG. 5B is a cross-section through the second guide section.
Figure 5A:
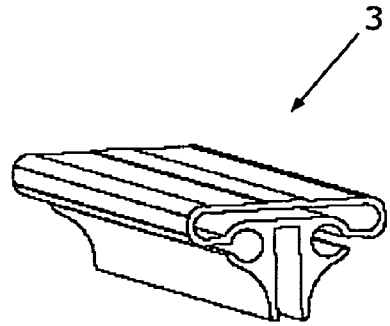
FIG. 5A is a depiction of a length of a second guide section according to the invention.

Shown in FIGS. 5A and 5B are details of a further embodiment of the guide section 3. FIG. 5A shows a perspective view of a short length of the guide section 3. Shown in FIG. 5B is a cross-section. The guide section 3 has a T-shaped cross-section in which the area of the handrail which the passenger grips with the hand is flat, i.e. not convex.

Figure 6B:
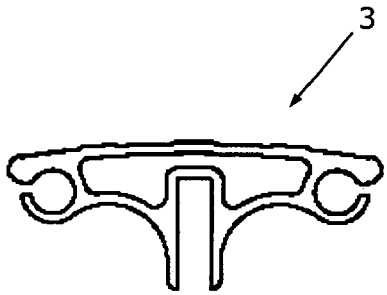
FIG. 6B is a cross-section through the third guide section.
Figure 6A:
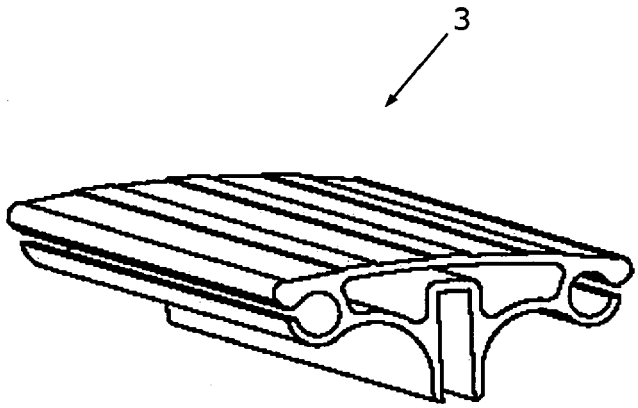
FIG. 6A is a depiction of a length of a third guide section according to the invention.

Shown in FIGS. 6A and 6B are details of a further embodiment of the guide section 3. FIG. 6A shows a perspective view of a short length of a guide section 3, which is also referred to as an "exit section" since it is particularly preferable for it to be used shortly before the end of a moving walk or escalator. Shown in FIG. 6B is a cross-section. The guide section 3 has a T-shaped or mushroom-shaped cross-section in which the area of the handrail which the passenger grips with the hand is flat or slightly convex. The width (in a direction perpendicular to the longitudinal axis L) of the guide section 3 in FIGS. 6A and 6B is greater than that in FIGS. 5A and 5B. This means that a hand that grips the handrail must be opened or stretched further on a handrail portion according to FIG. 6A, 6B. Through use of the special exit section, the users of the moving walk or escalator can be informed that they are approaching the exit. By this means the number of falls or even injuries that occur partly due to inattention can be reduced.

Figure 7B:
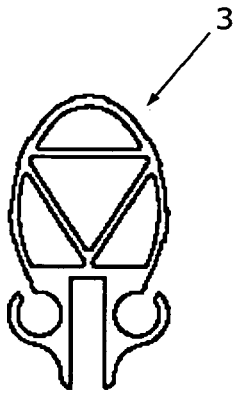
FIG. 7B is a cross-section through the fourth guide section.
Figure 7A:
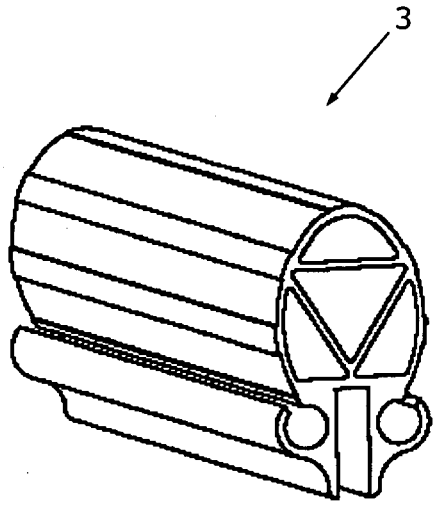
FIG. 7A is a depiction of a length of a fourth guide section according to the invention.

Shown in FIGS. 7A and 7B are details of yet a further embodiment of the guide section 3. FIG. 7A shows a perspective view of a short length of the guide section 3. Shown in FIG. 7B is a cross section. The guide section 3 has a mushroom-shaped cross-section in which the area of the handrail which the passenger grips with the hand is highly convex.

Figure 8B:
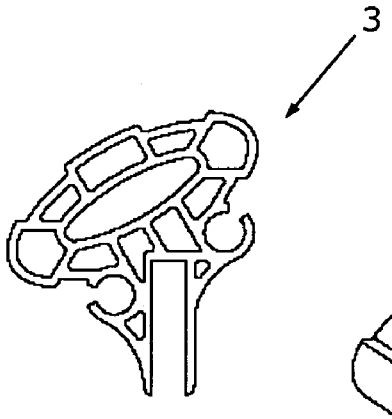
FIG. 8B is a cross-section through the fifth guide section.
Figure 8A:
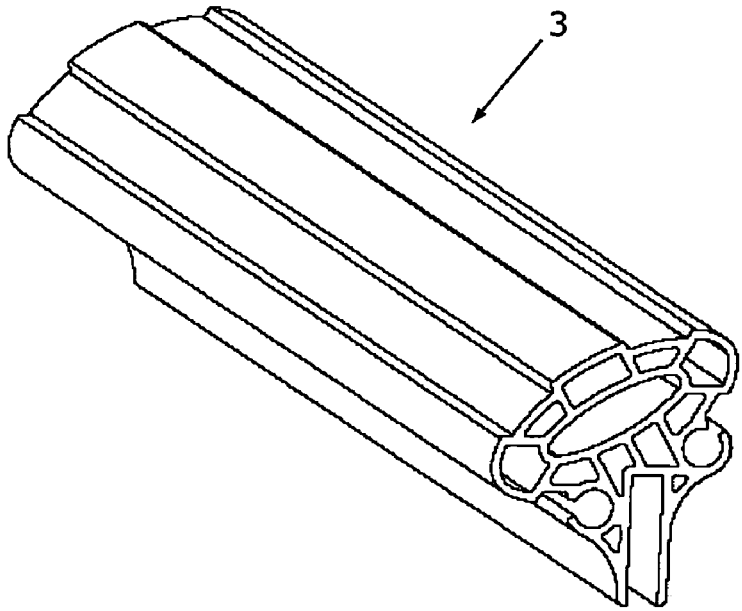
FIG. 8A is a depiction of a length of a fifth guide section according to the invention.

Shown in FIGS. 8A and 8B are details of a further embodiment of the guide section 3, which is also referred to as a sloping section. FIG. 8A shows a perspective view of a short section of the guide section 3. Shown in FIG. 8B is a cross-section. This guide section 3 has a mushroom-shaped cross-section in which the area of the handrail which the passenger grips with the hand is convex. Furthermore, the area is inclined toward the user of the escalator or moving walk.

Figure 9B:
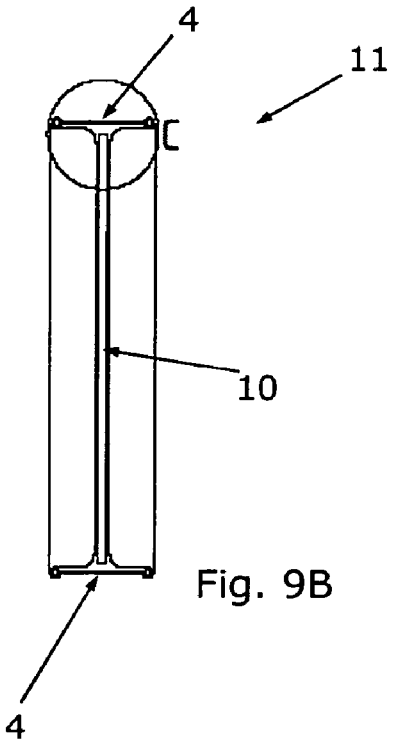
FIG. 9B is a cross-section through the handrail of FIG. 9A.
Figure 9A:
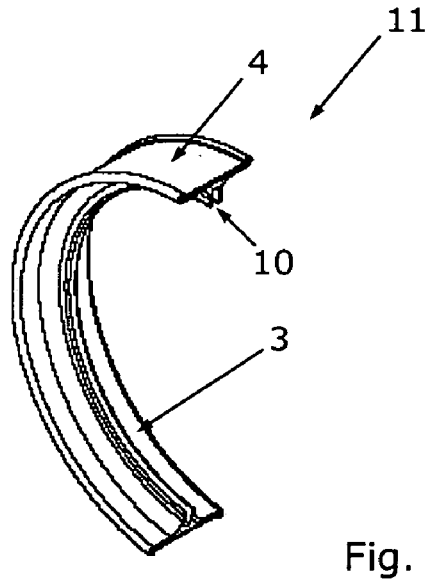
FIG. 9A is a depiction of a length of a handrail according to the invention.
Figure 9C:
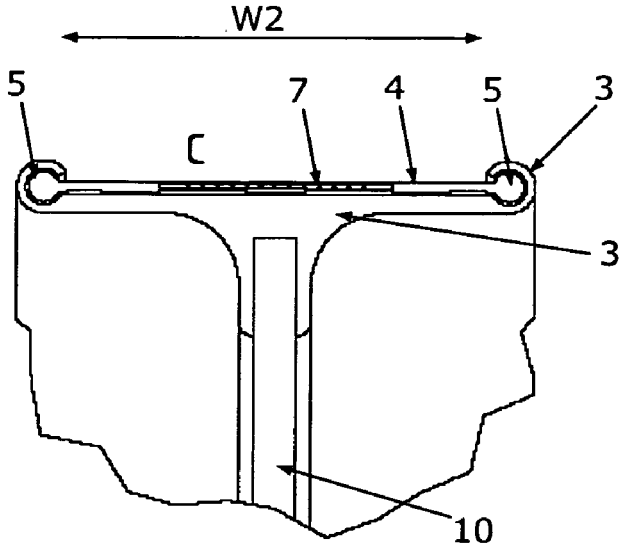
FIG. 9C is an enlarged detail of the handrail.

Shown in FIGS. 9A to 9C are details of a still further embodiment of the handrail 3 which has a guide section 3 that is referred to as a curve section. FIG. 9A shows a perspective view of a reversing curve 11 of a handrail. Shown in FIG. 9B is a cross-section through the complete reversing curve 11. FIG. 9C shows an enlarged cross section through an upper part C of the reversing curve 11 as indicated in FIG. 9B. In FIGS. 9A to 9C, in addition to the guide section 3, the base element 4 of the handrail body, including the edge-lips 5, is shown. The guide section 3 has a T-shaped cross-section in which the area of the handrail which the passenger grips with the hand is flat. This type of embodiment has the advantage that the base element 4 lies completely flat when it passes round the reversing curve 11. By this means, the flexing work (flexing loss) is kept very low.

Figure 10B:
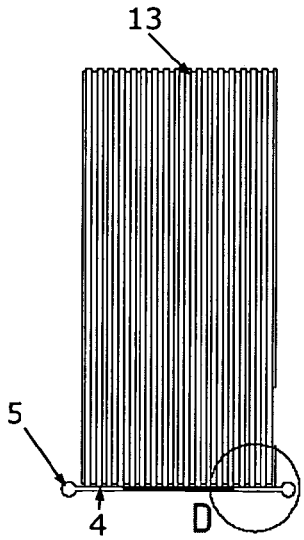
FIG. 10B is a cross-section through the handrail of FIG. 10A.
Figure 10A:
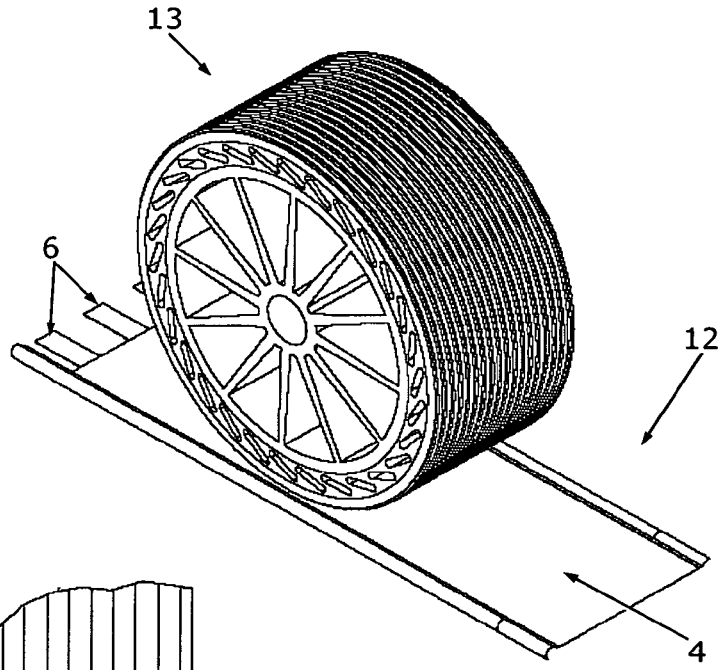
FIG. 10A is a depiction of a length of a further handrail according to the invention.
Figure 10C:
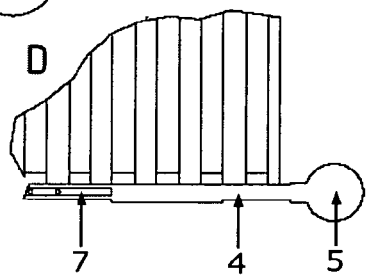
FIG. 10C is an enlarged detail of the handrail of FIG. 10A.

Shown in FIGS. 10A to 10C are details of a further embodiment of the guide section 3 which is also referred to as the drive section 12. FIG. 10A shows a perspective view of a drive section 12 of a handrail with a drive wheel 13. Shown in FIG. 10B is a cross-section through the drive section including drive wheel 13. FIG. 11C shows an enlarged cross- section through a lower part D of the drive section 12. Preferably, the drive wheel 13 drives the handrail by acting non-positively on one side of the base element 4. Embodiments are preferred in which the drive wheel 13 drives the front side of the base element 4, since on the back side of the base element gliding surfaces 16 or gliding areas are provided. The front side of the base element 4 is the side with which, in other areas of the handrail, the palm of the hand comes into contact.

In a preferred embodiment, the front side of the base element 4 is designed in such manner that it can be driven by the drive wheel 13 without great losses. For this purpose, the drive wheel 13 can be pressed against the front side of the base element 4 by a spring force or similar. Preferably, an idler is provided in the area of the drive wheel 13, the base element 4 being pulled through between the idler and the drive wheel 13.

By means of this embodiment of the drive section 12, larger contact surfaces can be made available on the drive system than on conventional handrails, since the guide section 3 is designed in such manner that the base element 4 of the handrail grip 2 is pressed completely flat against the drive wheel 13, or the drive wheel 13 is pressed against the base element 4, respectively.

In all the embodiments shown, the width of the base element (referenced in FIG. 2A as W2) from one edge-lip 5 to the other edge-lip 5 is identical. This means that the same handrail body 2 can be used on all the guide sections 3 that are shown. Depending on the shape of the guide section 3, the user receives a different handrail configuration.

So that the prescribed safety for the passenger can be provided, the guide sections 3 can be designed in such manner that the passenger has a safe grip on the handrail grip 2. The known C-shaped cross-section can be obtained with a correspondingly shaped guide section 3. FIGS. 4A and 4B show, for example, a guide section 3 that is an approximation to the known C-shaped cross-section.

Particularly preferable is a handrail whose cross section changes along its longitudinal axis L. This type of embodiment is referred to as a handrail with a variable cross-section. This will be described by reference to an example. From the beginning until approximately 1 meter before the end of a moving walk, for example, the handrail can have the shape shown in FIG. 4A. This shape can then transform gradually into the shape shown in FIG. 6A. This causes the hand with which the passenger holds onto the handrail to be spread. The passenger perceives this stimulus and is thereby informed that the end of the moving walk has been reached. This type of advance warning can also be important for people who are blind or otherwise impaired. In an alternative embodiment, it is also conceivable to have one or more signal ridges integrated in the guide section 3 which can be felt through the base element 4 and, for example, make a slight vibration perceptible in the palm of the hand.

The safety of the passenger can be improved even further if the guide section 3 transforms into an exit section shortly before the passenger steps off the escalator or moving walk. The exit section can, for example, be a flat section (FIG. 6A and FIG. 6B) or an oval section (FIG. 7A and FIG. 7B). The sloping section shown in FIGS. 8A and 8B can serve as exit section. By means of the transformation to the end-section, the passenger is made aware that the exit from the escalator or moving walk is imminent.

A further improvement in the safety of the passenger at the moment of exit can be attained by means of a handrail grip 2 that slopes toward the passenger. In this case, while the passenger is traveling on the escalator or moving walk, the geometry of the guide section 3 is so arranged that the handrail grip 2 slopes toward the passenger. The sloping section shown in FIGS. 8A and 8B can be used for this purpose.

So that, as described, the handrail according to the invention has to do less flexing work on the reversing curves and on the handrail driving wheel, the guide sections 3 can be so formed that the base element 4 of the handrail grip 2 is flat (see FIGS. 9A to 9C) so that the flexure in longitudinal direction L can take place more easily than is the case with the known C-shaped cross section.

Furthermore, in the area of the drive system, greater contact surfaces can be made available if the guide section 3 is so formed that the base element 4 of the handrail grip 2 is pressed completely flat (see FIG. 10A) against the drive wheel 13 or vice versa.

Because of the reduced amount of flexing work in the reversing curves, the improved gliding properties (reduced friction) that are achieved through the use of dedicated gliding surfaces 6 or gliding areas of the base element 4 and any gliding surfaces 9 of the guide section 3, and the greater contact surface for driving the handrail grip 2 and through the reduced volume and weight of the moving parts of the handrail, less driving power is required for the handrail according to the invention. Furthermore, fewer grinding noises occur and the handrail does not become as hot as sometimes occurs with the state of the art.

Handrails according to the state of the art sometimes have a so-called gliding layer on the inside of the handrail that is the contact surface of the handrail both for the handrail guide and the handrail drive system. According to the present invention the gliding function and the drive function are separated from each other, as described in relation to FIGS. 10A to 10C.

There are many further advantages associated with the invention that can be more or less pronounced depending on the embodiment, choice of materials, and dimensions. According to the invention, use is no longer made of a C-shaped cross-section with an inherently stable shape that is typically constructed of multiple layers. Furthermore, the cross-section of the handrail according to the invention or of the base element 4 respectively can be made extremely thin. The base element 4 can be made of a single material, e.g. an elastomer mixture or a fabric. To comply with safety requirements in passenger transportation, the thin and easily formable cross-section of the handrail according to the invention is given a user-friendly and ergonomic form by special guide sections 3, it being possible to specially adapt the geometry of the handrail along the escalator to the needs of the passengers. The handrail body 2 can be constructed, for example, of metal fabric, plastic fabric, natural fiber, or filling material inside a casing. Such filling materials are, for example, gel, liquid and foam. The casing may be a tube or PVC sheath.

According to the invention, there are only a small number of tensile supports 7, for example steel ropes, to bear longitudinal forces. Furthermore, with the invention it is possible to have a separation of the contact surface into a handrail guide surface, preferably provided with gliding surfaces 6, and a handrail drive surface, it thus being possible to individually optimize these surfaces for the respective application.

In a special embodiment, at least part of the base element can be made transparent. This allows a lighting and/or safety effect to be achieved. For example, a change in lighting at the beginning and/or end of a handrail can raise the level of attention.

Also by means of the flexible geometry of the handrail according to the invention, the gliding surfaces and drive surfaces can be purposefully separated. With suitable optimization, this can attain improved drive performance and gliding performance. This results in a longer life for the handrail. With improved gliding surfaces it may also be possible to dispense with ball bearings in the reversing curves.

The stability of form of the handrail according to the invention is attained by interaction. In other words, the structural stability is attained when the base element 4 is arranged around the guide section 3.

In contrast with the state of the art, the base element 4 is not itself permanently formed. The base element 4 has very low horizontal (lateral) and vertical (normal) stability. Furthermore, the base element 4 has a very low torsional rigidity. It must, however, have a sufficiently high tensile strength. In other words, a minimum tensile strength must be assured.

The application of this invention has been described by reference to various embodiments. As stated at the outset, the invention can be used not only on moving walks, as the term is used in a conventional sense, but also on escalators.

Thanks to the relatively flexible construction of the handrail according to the invention, spiral or curved moving walks can be realized without difficulty. With the handrail according to the invention, it is possible to incorporate even small radii of curvature without difficulty and without causing excessive resistance or wear and accompanying grinding noises in handrail operation.

The handrail can also be used with particular advantage as a carrier of advertising.

Moving walks and escalators according to the invention can be used at trade fairs, exhibitions, railroad stations, and so on.

We claim:

1. A handrail for a moving walk that has a fixed guide device and a handrail body that moves along the guide device when in operation, characterized in that:

the guide device has a form-giving guide section that contains a lip-guide that extends along a longitudinal direction of the guide section;

at least a partial length of the guide section is of T-shaped or mushroom-shaped cross-section with an oval, circular, or arcuate upper surface;

the handrail body is strip-shaped and has two edge-lips that extend along two longitudinal edges of the handrail body and are formed in such manner that when the handrail body moves they run in the lip-guide parallel to the longitudinal direction;

the guide section essentially defining a form of the handrail in a direction parallel to the longitudinal direction and in a cross-sectional plane perpendicular to the longitudinal direction.

2. The handrail according to claim 1, characterized in that the handrail body has a flat base element having a longitudinal axis and the two longitudinal edges;

the edge-lips being arranged in the area of the longitudinal edges;

the base element being laterally formable, being twistable about the longitudinal axis of the base element, and being resistant to extension in the direction of the longitudinal axis of the base element.

3. The handrail according to claim 2, characterized in that each of the edge-lips is made of material capable of gliding, is coated with a gliding material, or is provided with a gliding surface.

4. The handrail according to claim 1 or 2, characterized in that at least one gliding surface extending parallel to the longitudinal direction is provided on the handrail body on a side that, in an installed state, faces the guide section.

5. The handrail according to claim 4, characterized in that the guide section has at least one gliding section that is oriented to be in contact with the gliding surface of the handrail body.

6. The handrail according to claim 1, 2 or 3, characterized in that a tensioning means is associated with the handrail body to lend a minimum resistance to extension of the handrail body in its longitudinal direction in an installed state.

7. The handrail according to claim 1, 2 or 3, characterized in that the handrail body is constructed of one or more of an elastomer, a fiber-reinforced plastic, a metal fabric, a plastic fabric, a natural fiber, and a filling material in a casing.

8. The handrail according to claim 1, 2 or 3, characterized in that a cross section of the guide section changes along a direction parallel to the longitudinal direction.

9. A moving walk having a balustrade and a handrail according to claim 1, 2 or 3.

10. The moving walk according to claim 9, characterized in that the moving walk has an end area, a middle area and a drive area, and the handrail has a different form in at least two of the end, middle and drive areas.

11. The moving walk according to claim 10, characterized in that the form of the handrail in the drive area is a form that provides a contact surface to engage a driving means.

12. The moving walk according to claim 10, wherein the contact surface is flat.

13. A handrail for a moving walk that has a fixed guide device and a handrail body that moves along the guide device when in operation, characterized in that:

the guide device has a form-giving guide section that contains a lip-guide that extends along a longitudinal direction of the guide section;

a cross section of the guide section changes along a direction parallel to the longitudinal direction;

the handrail body is strip-shaped and has two edge-lips that extend along two longitudinal edges of the handrail body and are formed in such manner that when the handrail body moves they run in the lip-guide parallel to the longitudinal direction;

the guide section essentially defining a form of the handrail in a direction parallel to the longitudinal direction and in a cross-sectional plane perpendicular to the longitudinal direction.

14. A moving walk having a balustrade, a handrail with a fixed guide device and a handrail body that moves along the guide device when in operation, characterized in that:

the guide device has a form-giving guide section that contains a lip-guide that extends along a longitudinal direction of the guide section;

the moving walk has an end area, a middle area and a drive area, and the handrail has a different form in at least two of the end, middle and drive areas;

the handrail body is strip-shaped and has two edge-lips that extend along two longitudinal edges of the handrail body and are formed in such manner that when the handrail body moves they run in the lip-guide parallel to the longitudinal direction;

the guide section essentially defining a form of the handrail in a direction parallel to the longitudinal direction and in a cross-sectional plane perpendicular to the longitudinal direction.

15. The handrail according to claim 13 or 14, characterized in that the handrail body has a flat base element having a longitudinal axis and the two longitudinal edges;

the edge-lips being arranged in the area of the longitudinal edges;

the base element being laterally formable, being twistable about the longitudinal axis of the base element, and being resistant to extension in the direction of the longitudinal axis of the base element.

16. The handrail according to claim 13 or 14, characterized in that each of the edge-lips is made of material capable of gliding, is coated with a gliding material, or is provided with a gliding surface.

* * * * *